US008100137B2

(12) United States Patent
Tsai

(10) Patent No.: US 8,100,137 B2
(45) Date of Patent: Jan. 24, 2012

(54) HAIR ORNAMENT

(76) Inventor: Kai-Mou Tsai, Taipei (TW)

( * ) Notice: Subject to any disclaimer, the term of this patent is extended or adjusted under 35 U.S.C. 154(b) by 280 days.

(21) Appl. No.: 12/458,409

(22) Filed: Jul. 10, 2009

(65) Prior Publication Data

US 2011/0005547 A1 Jan. 13, 2011

(51) Int. Cl.

| | |
|---|---|
| ***A45D 8/12*** | (2006.01) |
| ***A45D 8/28*** | (2006.01) |
| ***A41F 1/00*** | (2006.01) |
| *A45D 8/06* | (2006.01) |

(52) U.S. Cl. ..... 132/275; 132/279; 132/283; 24/489

(58) Field of Classification Search ..... 132/61, 132/62, 146, 275, 276, 278, 280, 281, 282, 132/283, 284; D28/39, 41, 42; 24/489, 521
See application file for complete search history.

(56) References Cited

U.S. PATENT DOCUMENTS

| | | | | |
|---|---|---|---|---|
| 5,271,421 | A * | 12/1993 | Videtzky | 132/200 |
| D540,982 | S * | 4/2007 | Vergona | D28/40 |
| 2008/0223396 | A1 * | 9/2008 | Hsu | 132/279 |

* cited by examiner

*Primary Examiner* — Todd Manahan
*Assistant Examiner* — Niyati D Shah
(74) *Attorney, Agent, or Firm* — Rosenberg, Klein & Lee

(57) ABSTRACT

An hair ornament includes a hairpin, which has an eyelet and two spiral spring wires extended from the eyelet and spirally intersected with each other, an ornament, and a connector, which has a front end fastened to the eyelet of the hairpin and a rear end pivotally connected to the ornament for enabling the hairpin to be biased relative to the ornament between an open position for insertion through the hair of a user and a close position to secure the ornament to the hair of the user.

7 Claims, 13 Drawing Sheets

HAIR ORNAMENT

BACKGROUND OF THE INVENTION

1. Field of the Invention

The present invention relates to hair ornamental devices and more particularly, to a hair ornament, which has a hairpin for fastening to a user's head, an ornament for decoration, and a connector pivotally connect the ornament to the hairpin.

2. Description of the Related Art

Many hair fastening devices such as hairpins, hair clips and hair bands are known and commercially available. When using a hair clip to fasten the hair of a user, the user's hair may be damaged or ugly curved.

Further, when a hair band is used to fasten the hair of a user, the hair band must provide sufficient binding force to secure the hair in shape. However, the binding force of the hair band may cause the user's head to feel uncomfortable. When dismounting the hair band, the user's hair may be stretched, causing hurt.

SUMMARY OF THE INVENTION

The present invention has been accomplished under the circumstances in view. It is one object of the present invention to provide a hair ornament, which uses a hairpin for securing an ornament to the hair of a user that has two spiral spring wires spirally intersected with each other for insertion through the hair of a user by means of a rotation motion.

It is another object of the present invention to provide a hair ornament, which uses a connector to pivotally connect a hairpin to an ornament so that the hairpin and the ornament work as a hair clip.

BRIEF DESCRIPTION OF THE DRAWINGS

Other and further benefits, advantages and features of the present invention will be understood by reference to the following specification in conjunction with the accompanying drawings, in which like reference characters denote like elements of the disclosure.

DETAILED DESCRIPTION OF THE PREFERRED EMBODIMENT

Figure 1:
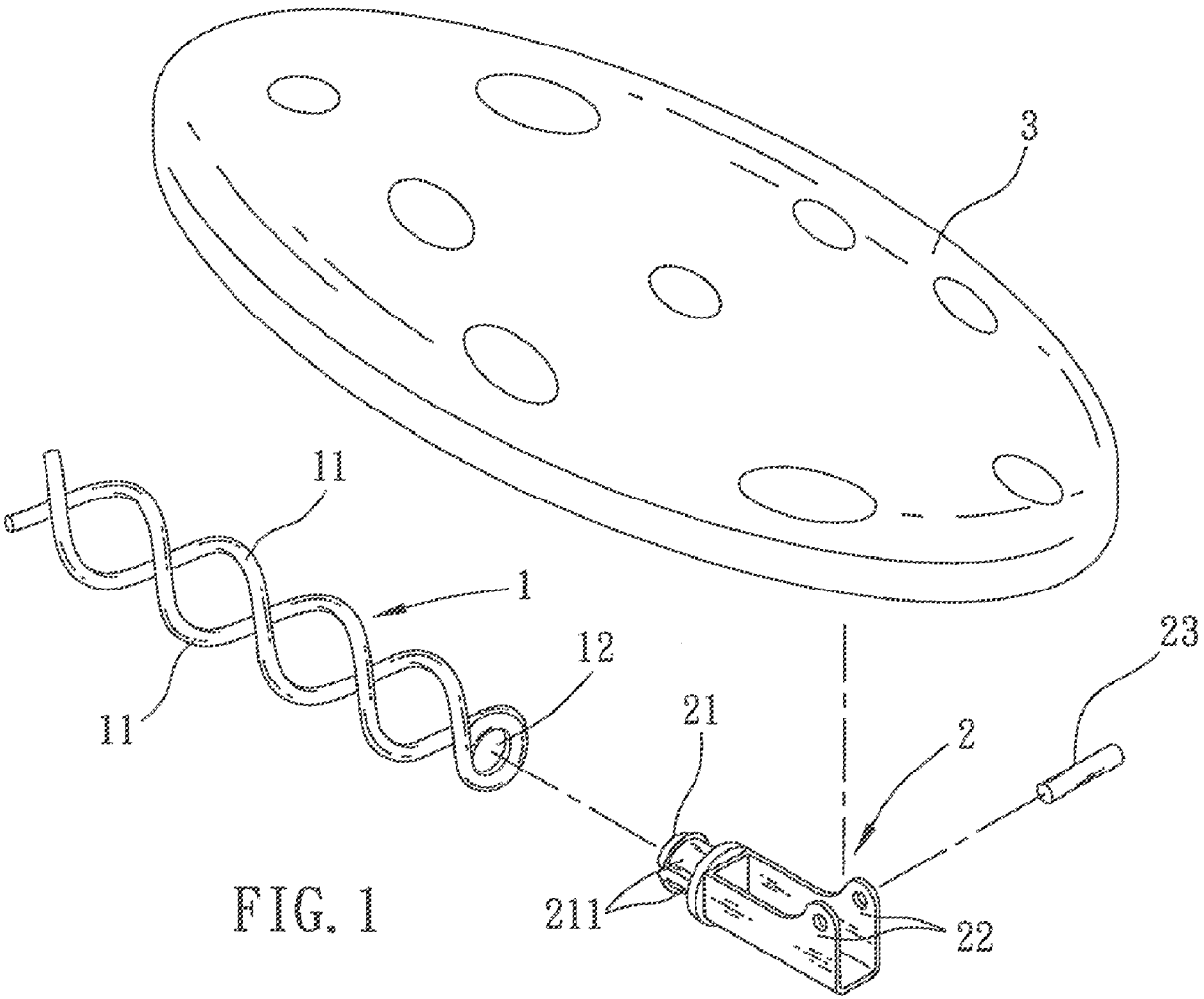
FIG. 1 is an exploded view of a hair ornament in accordance with a first embodiment of the present invention.
Figure 2:
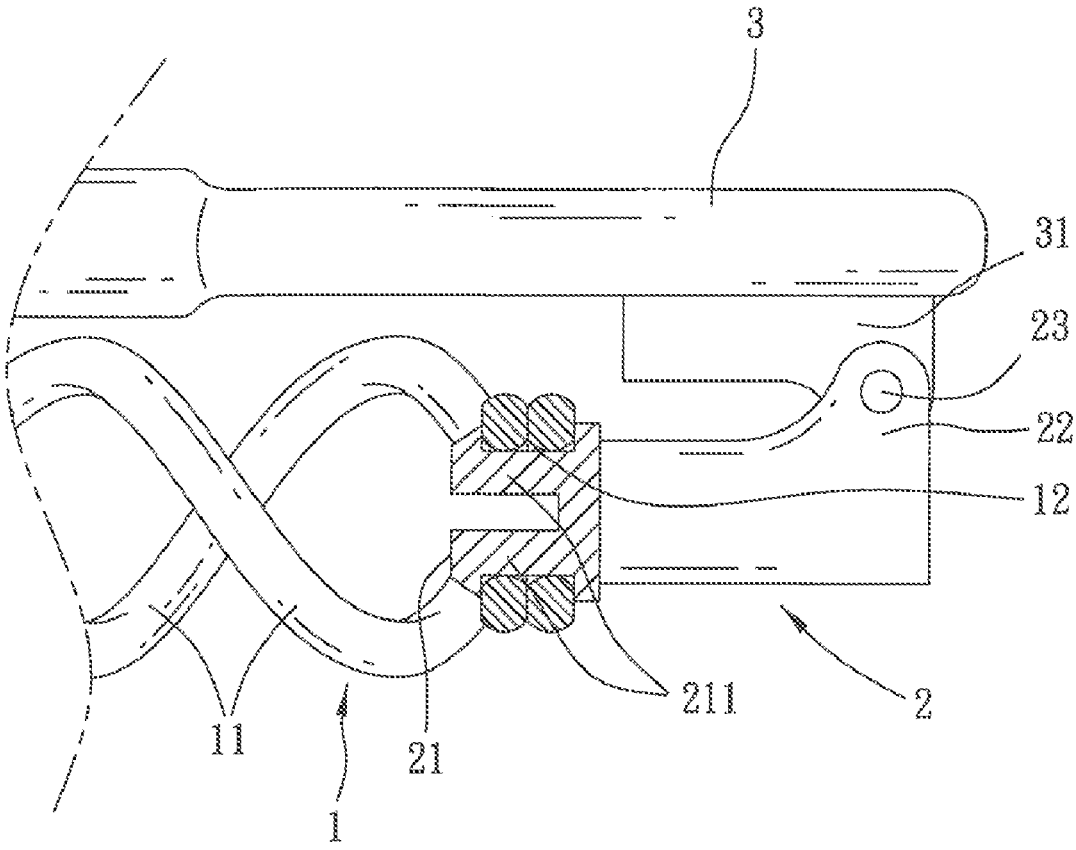
FIG. 2 is a sectional assembly view, in an enlarged scale, of a part of the hair ornament in accordance with the first embodiment of the present invention.

Referring to FIGS. 1 and 2, a hair ornament in accordance with a first embodiment of the present invention is shown comprising a hairpin 1, a connector 2 and an ornament 3.

The hairpin 1 has an eyelet 12 connectable to the connector 2, and two spiral spring wires 11 extended from the eyelet 12 and spirally intersected with each other. The connector 2 has a connection rod 21 located on one end thereof and fastened to the eyelet 12 of the hairpin 1, and a mounting lug 22 located on the other end thereof and extending in direction perpendicular to the axis of the connection rod 21 and pivotally connected by pivot pin 23 to a connecting element 31 on the bottom side of the ornament 3. The connection rod 21 is a split bolt having multiple springy bolt elements 211 that can be compressed radially inwardly and then inserted through the eyelet 12. After insertion of the springy bolt elements 211 of the connection rod 21 through the eyelet 12, the springy bolt elements 211 return to their former shape and are firmly secured to the eyelet 12.

Figure 3:
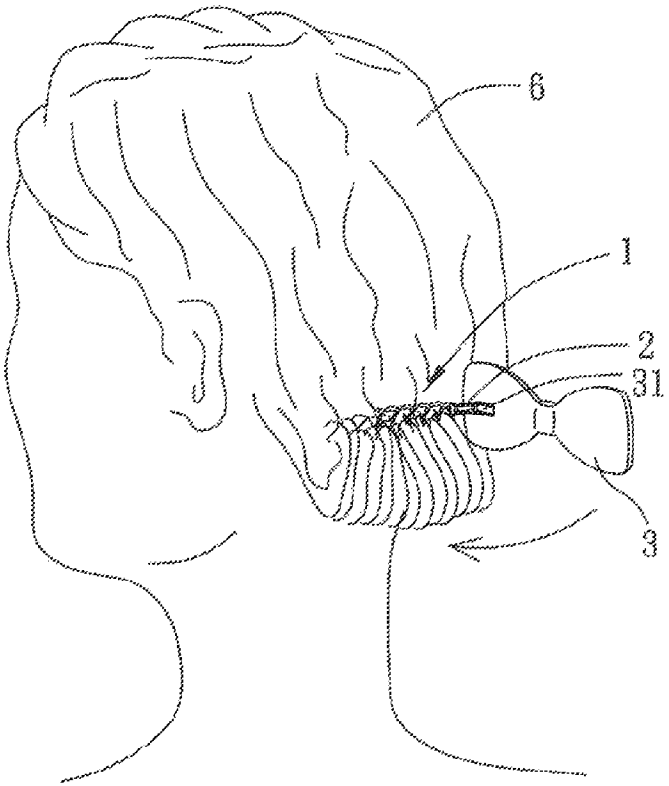
FIG. 3 is a schematic drawing showing one installation example of the hair ornament in accordance with the first embodiment of the present invention.
Figure 4:
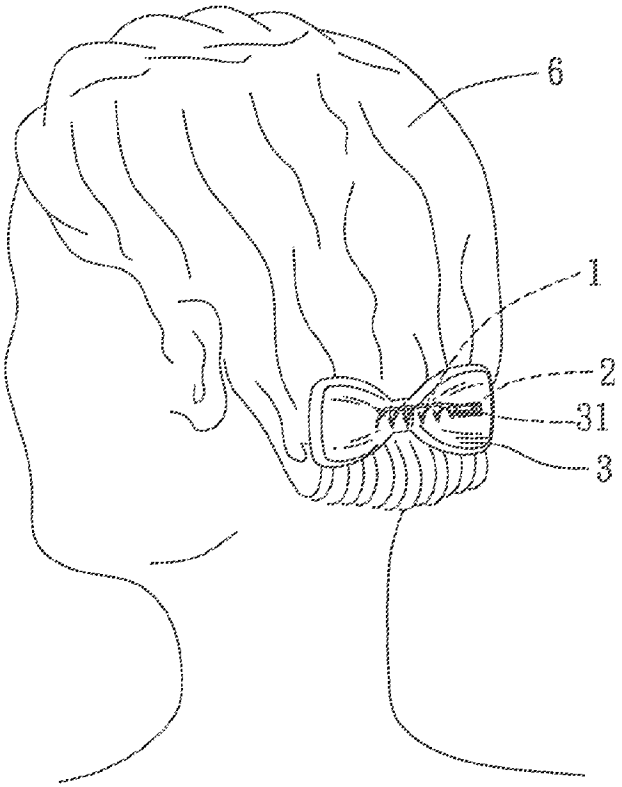
FIG. 4 corresponds to FIG. 3, showing the hair ornament fastened to the hair.
Figure 5:
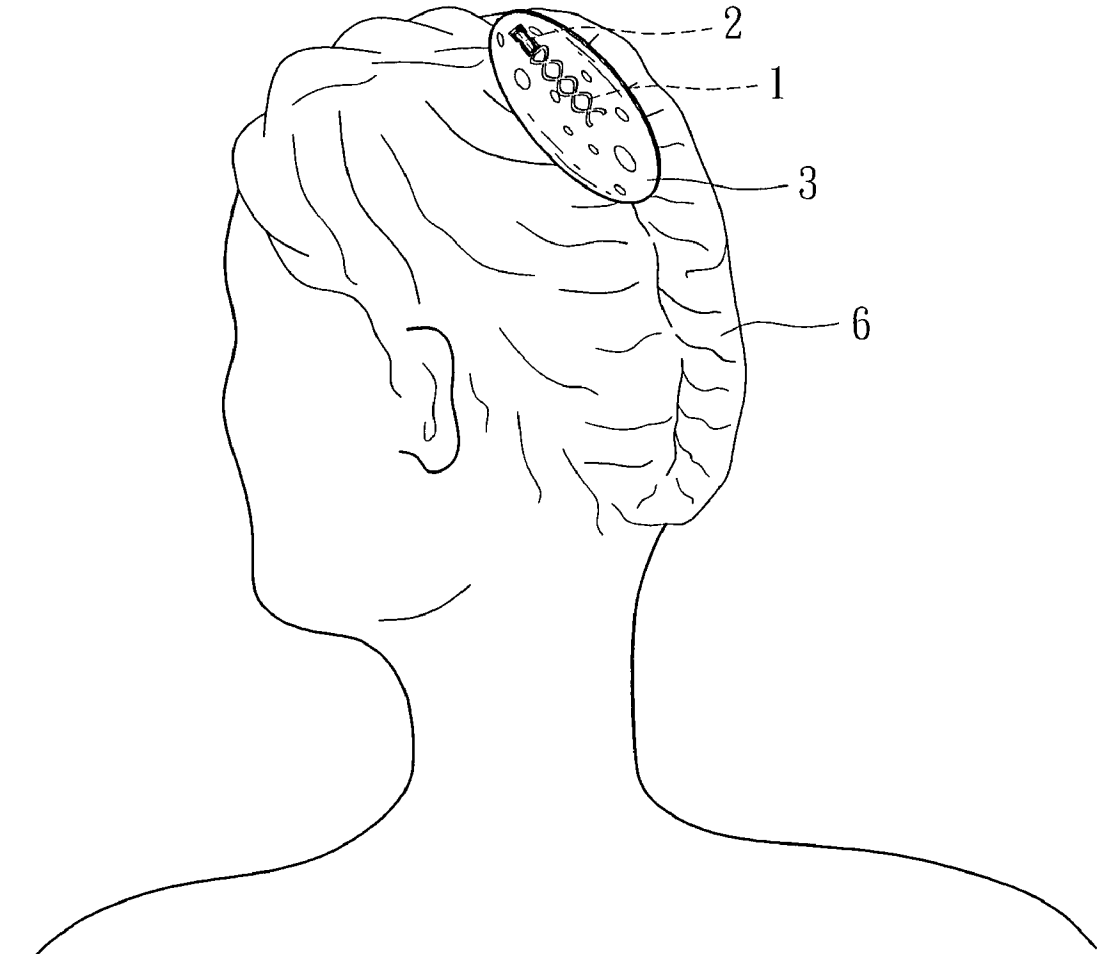
FIG. 5 is a schematic drawing showing another installation example of the hair ornament in accordance with the first embodiment of the present invention.

Referring to FIGS. 3~5, the hairpin 1 can be biased with the connector 2 relative to the ornament 3 between a closed position where the hairpin 1 is closely attached to the bottom side of the ornament 3 and an open position where the hairpin 1 is kept apart from the ornament 3. When the hairpin 1 is opened from the ornament 3, it can be rotated and inserted through the hair of a user. After insertion of the hairpin 1 through the hair of the user, the hair is secured to the spaces in between the two spiral spring wires 11 of the hairpin 1, and then the ornament 3 is biased relative to the connector 2 and the hairpin 1 and closely attached to the hairpin 1. Thus, the hairpin 1 and the ornament 3 produce a clamping force to the user's hair and are secured to the user's hair in place.

Figure 6:
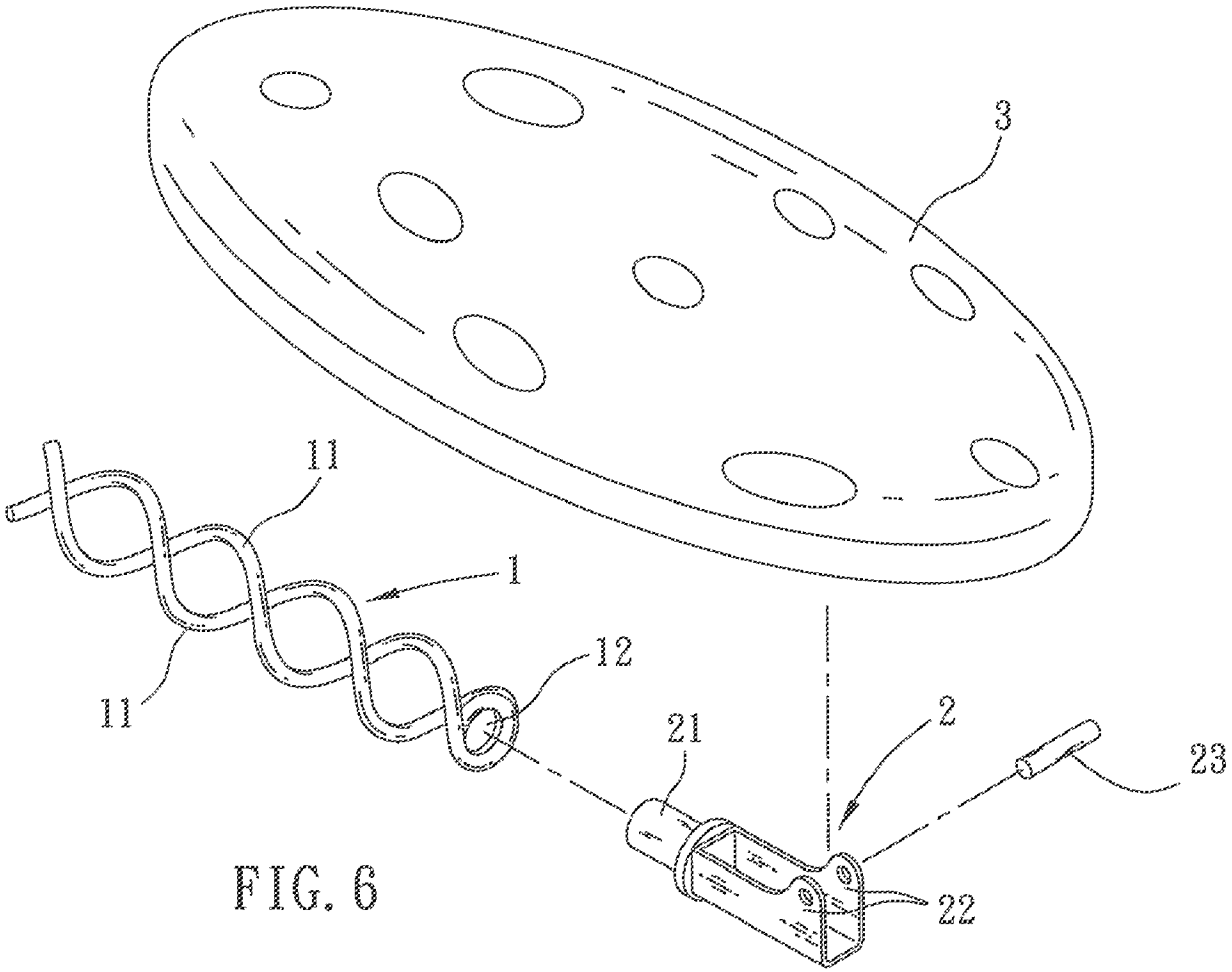
FIG. 6 is an exploded view of a hair ornament in accordance with a second embodiment of the present invention.
Figure 7:
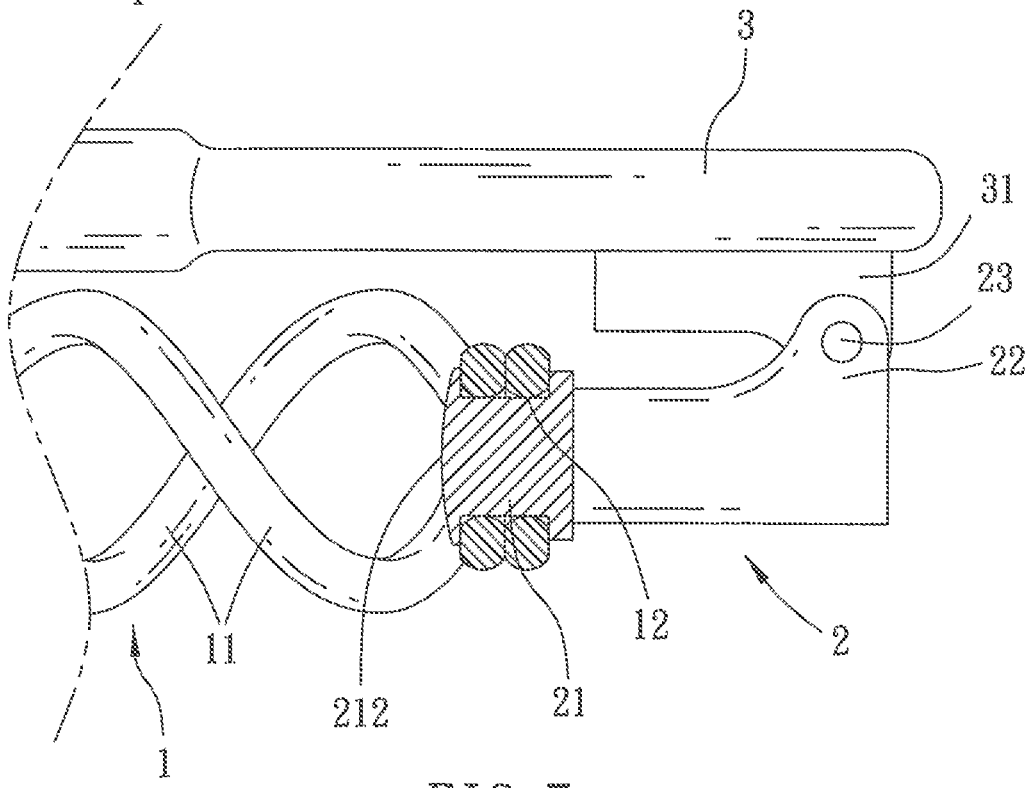
FIG. 7 is a sectional assembly view, in an enlarged scale, of a part of the hair ornament in accordance with the second embodiment of the present invention.

FIGS. 6 and 7 show a hair ornament in accordance with a second embodiment of the present invention. This second embodiment is substantially similar to the aforesaid first embodiment with the exception that the connection rod 21 is a plain metal rod that is hammered down to form a head 212 at its free end after insertion through the eyelet 12, thereby securing to the eyelet 12 of the hairpin 1 firmly. Alternatively, the connection rod 21 can be a plastic rod that is molded through a hot press molding technique to form a head at its free end after insertion through the eyelet 12.

Figure 9:
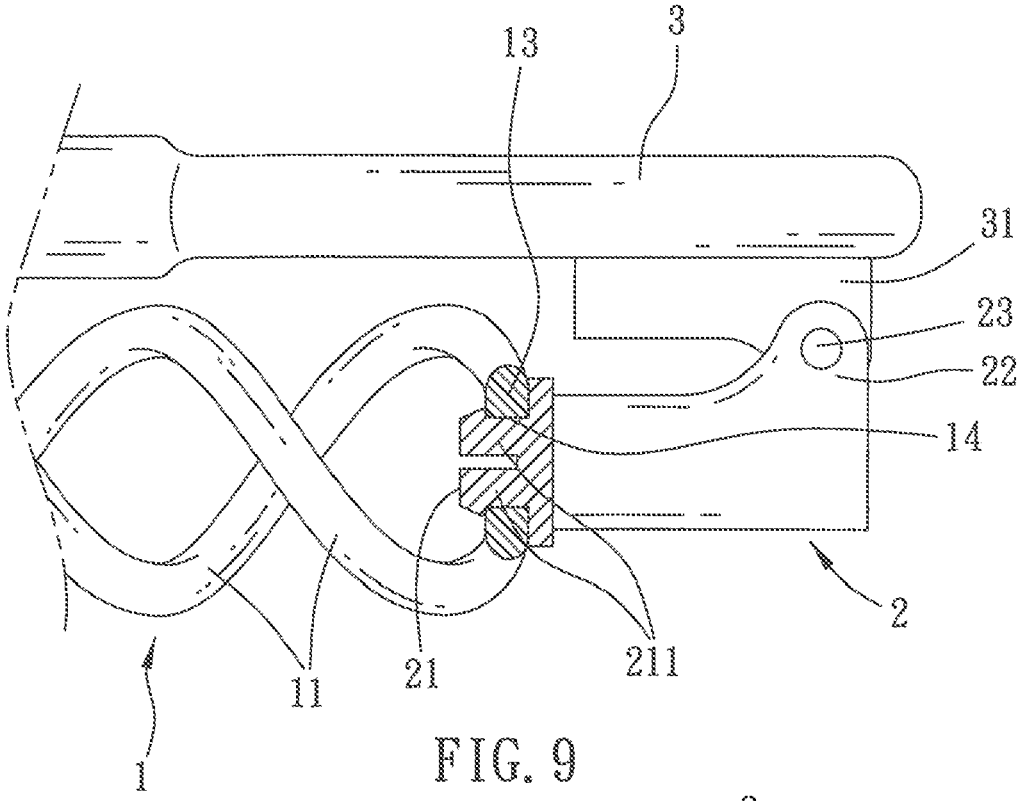
FIG. 9 is a sectional assembly view, in an enlarged scale, of a part of the hair ornament in accordance with the third embodiment of the present invention.
Figure 8:
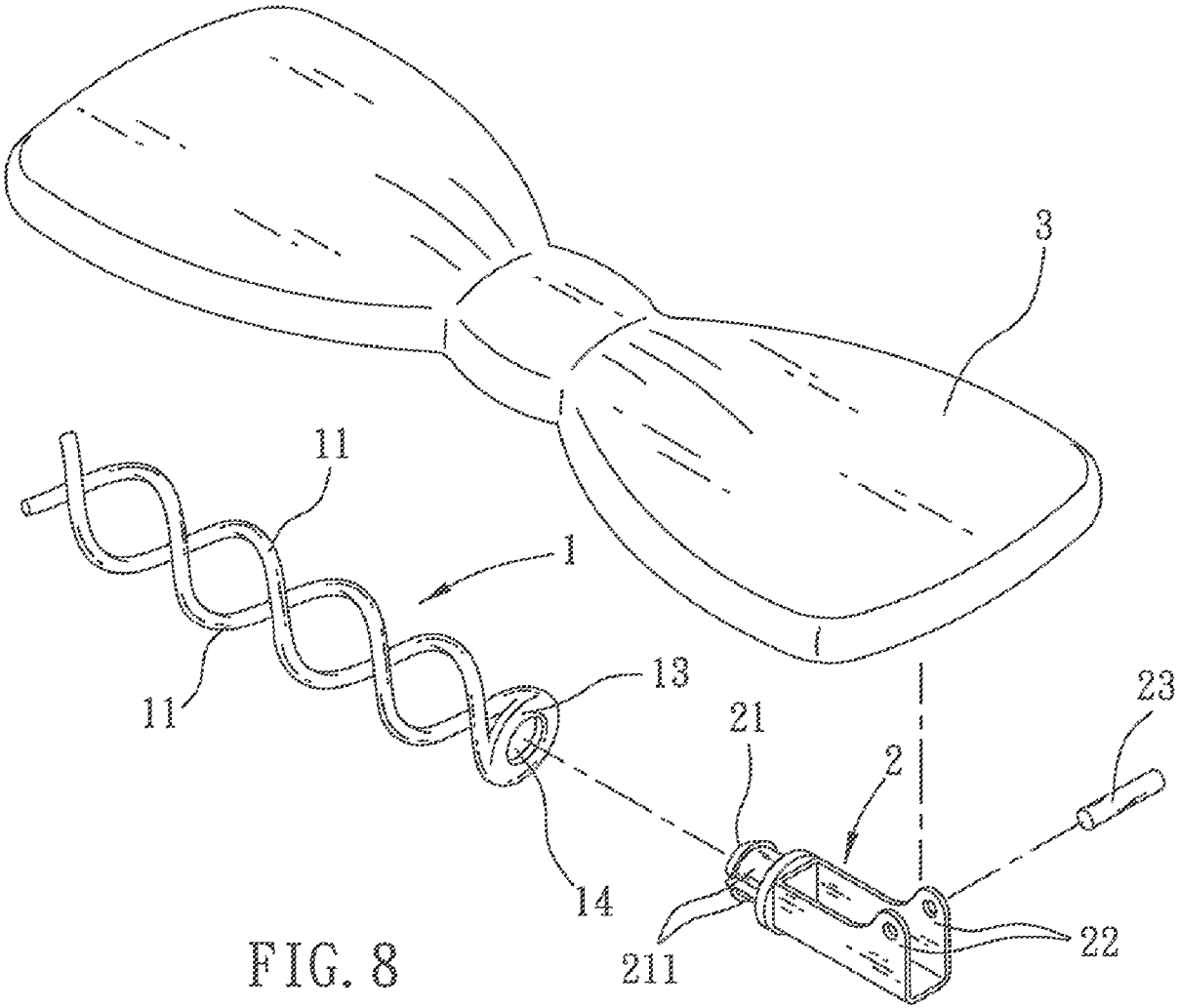
FIG. 8 is an exploded view of a hair ornament in accordance with a third embodiment of the present invention.

FIGS. 8 and 9 show a hair ornament in accordance with a third embodiment of the present invention. This third embodiment is substantially similar to the aforesaid first embodiment with the exception that the hairpin 1 according to the third embodiment comprises a connection plate 13 formed integral with one end of each of the spiral spring wires 11, and a through hole 14 cut through the connection plate 13 for the mounting of the springy bolt elements 211 of the connection rod 21.

Figure 10:
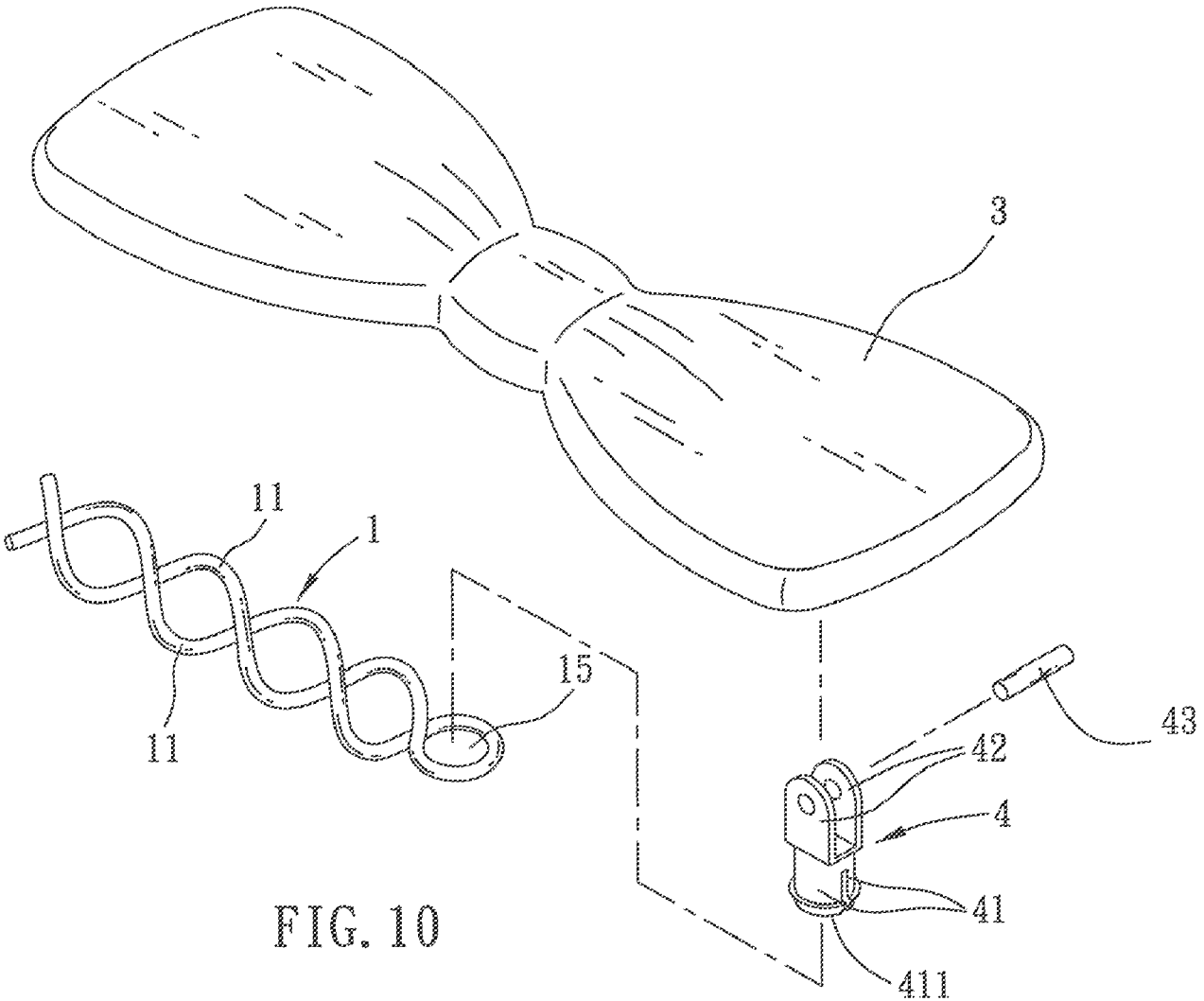
FIG. 10 is an exploded view of a hair ornament in accordance with a fourth embodiment of the present invention.
Figure 11:
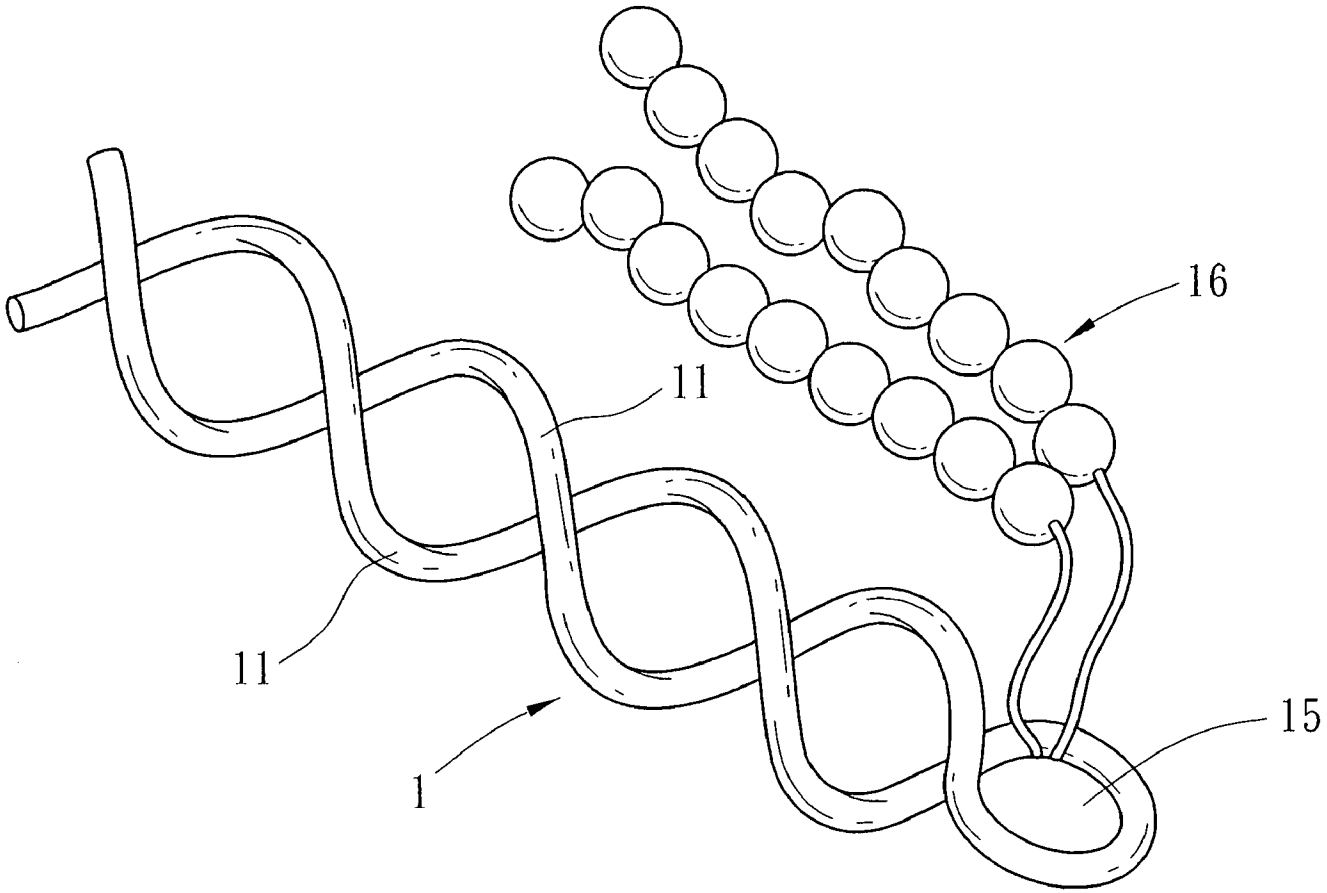
FIG. 11 illustrates ornamental strings of beads fastened to the eyelet of the hairpin for hair ornament in accordance with the fourth embodiment of the present invention.

FIG. 10 is an exploded view of a hair ornament in accordance with a fourth embodiment. Substantially similar to the aforesaid first embodiment, the hair ornament in accordance with this fourth embodiment comprises a hairpin 1, an ornament 3, and a connector 4 connected between the hairpin 1 and the ornament 3. The hairpin 1 comprises two spiral spring wires 11 and an eyelet 15 formed integral with one end of each of the two spiral spring wires 11. The axis of the eyelet 15 extends in direction perpendicular to the extending direction of the spiral spring wires 11. The connector 4 has a connection rod 41 located on one end thereof and fastened to the eyelet 15 of the hairpin 1, and a mounting lug 42 located on the other end thereof and extending axially in the reversed direction relative to the connection rod 41 and pivotally connected to the bottom side of the ornament 3 by the pivot pin 43. Further, the eyelet 15 of the hairpin 1 may be provided with ornamental strings of beads 16, as shown in FIG. 11.

Figure 12:
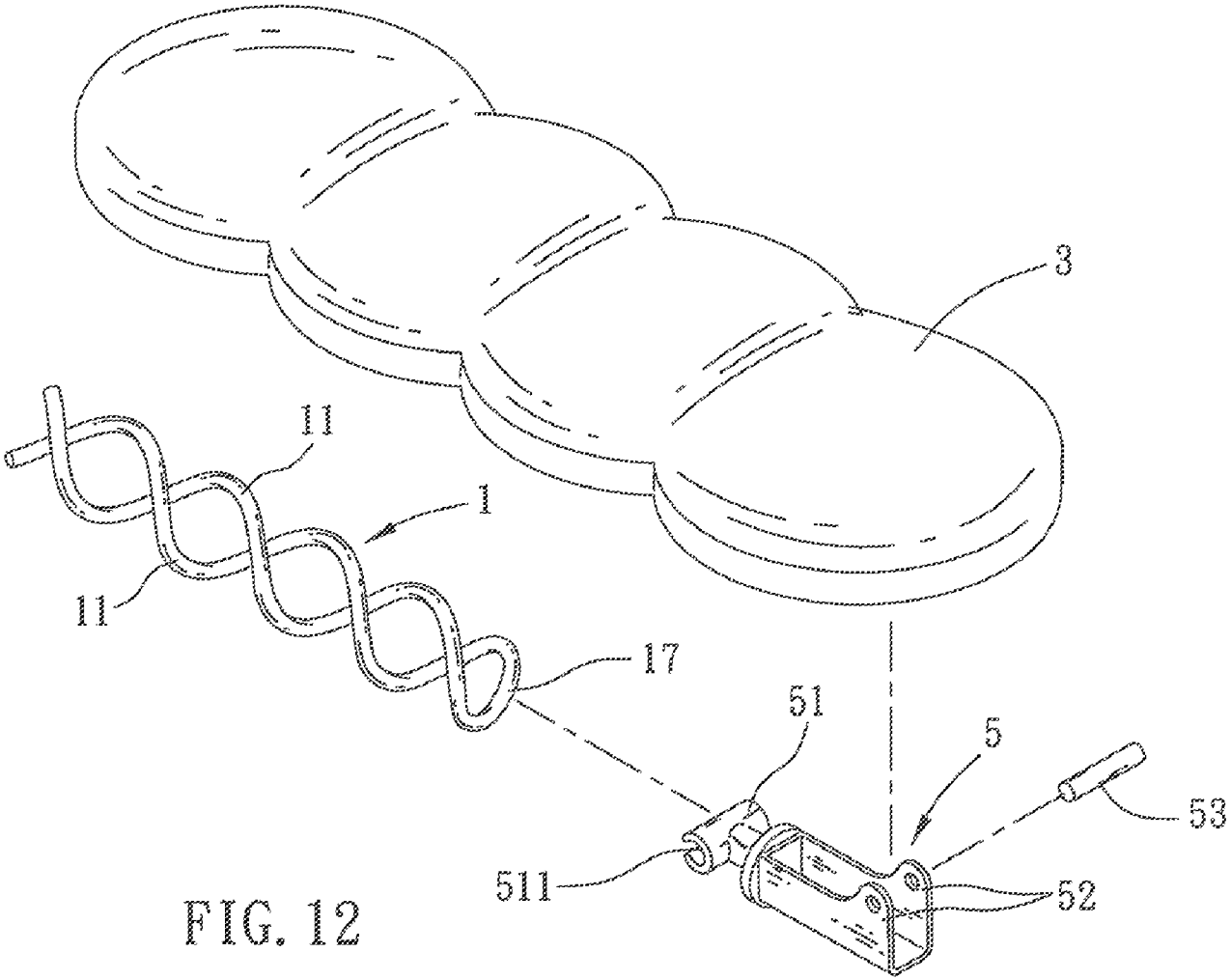
FIG. 12 is an exploded view of a hair ornament in accordance with a fifth embodiment of the present invention.

FIG. 12 is an exploded view of a hair ornament in accordance with a fifth embodiment of the present invention. According to this fifth embodiment, the hair ornament comprises a hairpin 1, a connector 5 and an ornament 3. The hairpin 1 has two spiral spring wires 11 and a transverse connection rod portion 17 connected between one end of each of the two spiral spring wires 11. The connector 5 has a connection portion 51 located on one end thereof and defining therein a retaining groove 511 that is fastened to the transverse connection rod portion 17 of the hairpin 1, and a mounting lug 52 located on the other end thereof and pivotally connected to the bottom side of the ornament 3 by the pivot pin 53. Further, the ornament 3 can be made in any of a variety of shapes and having any of a variety of designs.

Figure 14:
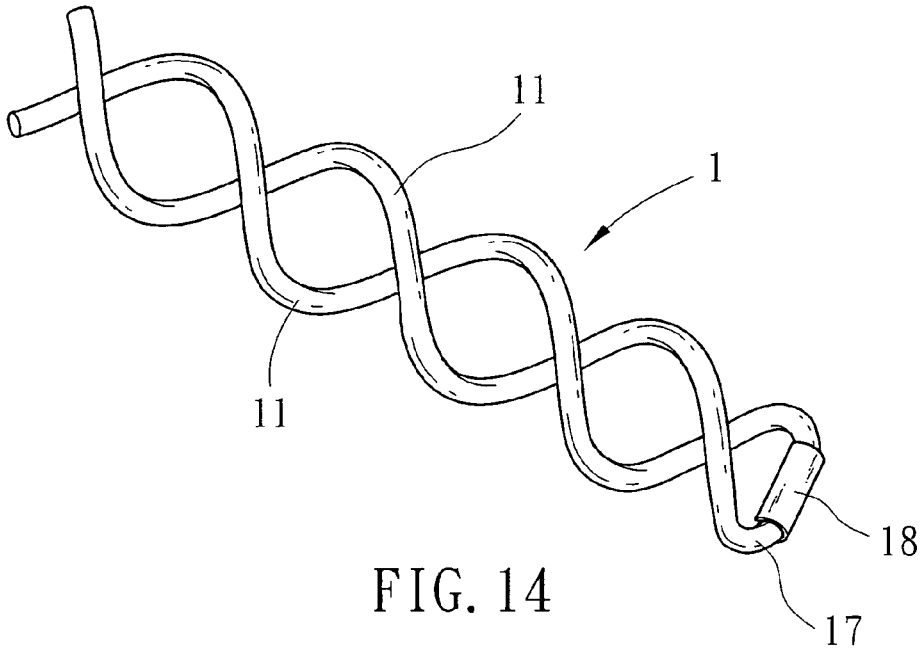
FIG. 14 is an assembly view of FIG. 13.
Figure 13:
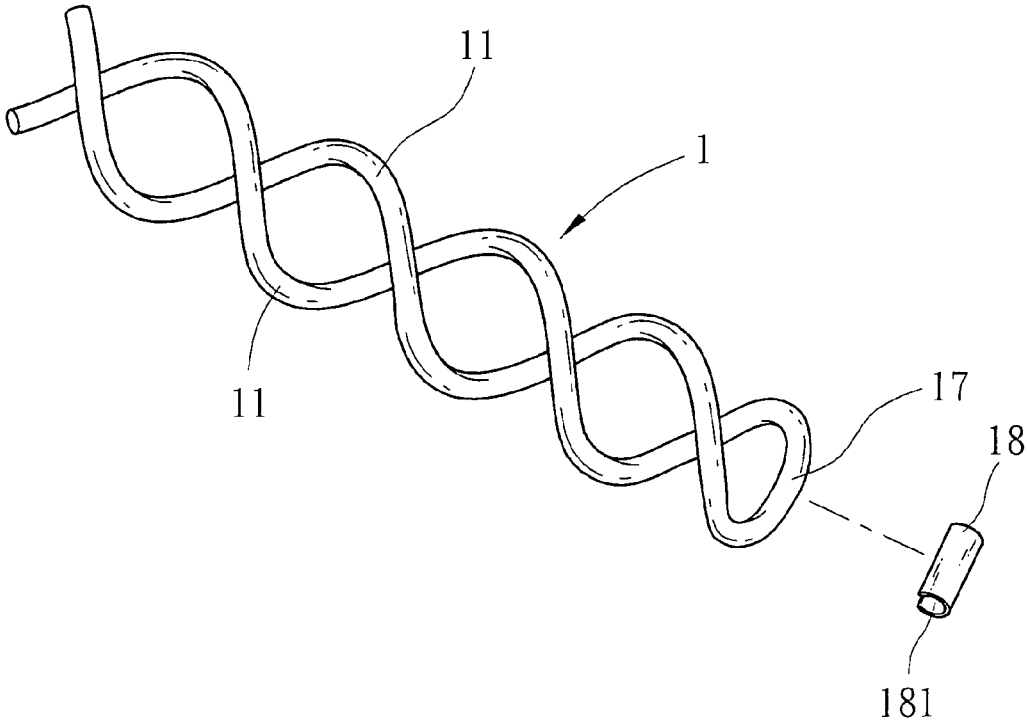
FIG. 13 is an exploded view of a hair ornament in accordance with a sixth embodiment of the present invention.

FIGS. 13 and 14 show a hair ornament in accordance with a sixth embodiment of the present invention. According to this sixth embodiment, the hair ornament comprises a hairpin 1 and a decorative metal fitting 18. The hairpin 1 is same as that of the aforesaid fifth embodiment. The decorative metal fitting 18 has a mounting groove 181 for fastening to the transverse connection rod portion 17 of the hairpin 1.

Figure 15:
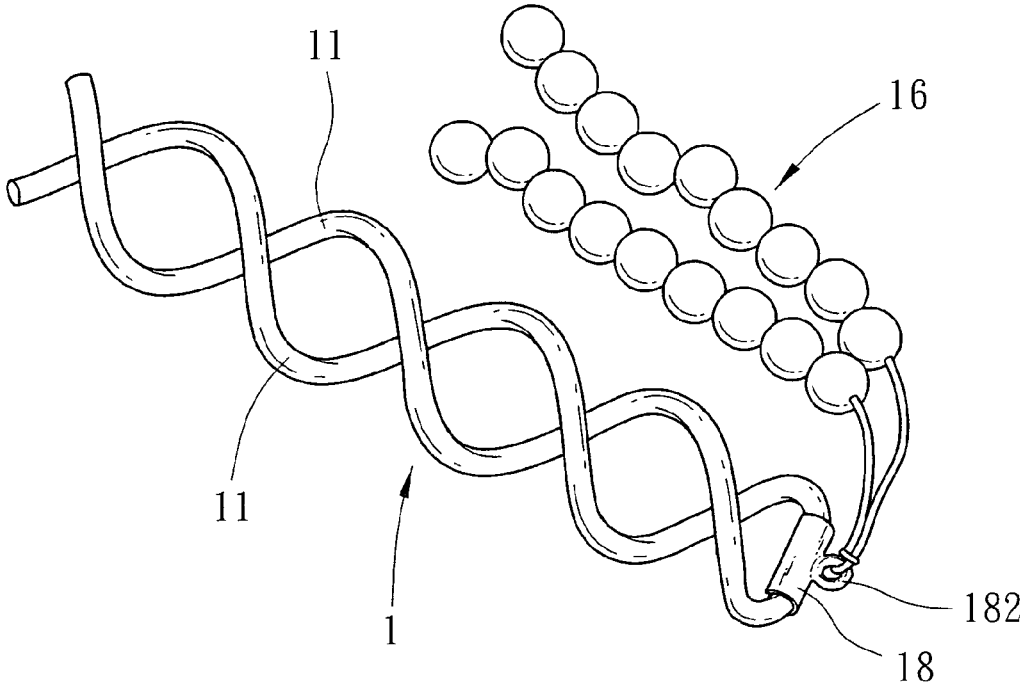
FIG. 15 illustrates a hair ornament in accordance with a seventh embodiment of the present invention.

FIG. 15 illustrates a hair ornament in accordance with a seventh embodiment of the present invention. This embodiment is substantially similar to the aforesaid sixth embodiment with the exception that the decorative metal fitting 18 has a ring 182 for the mounting of ornamental strings of beads 16.

Figure 16:
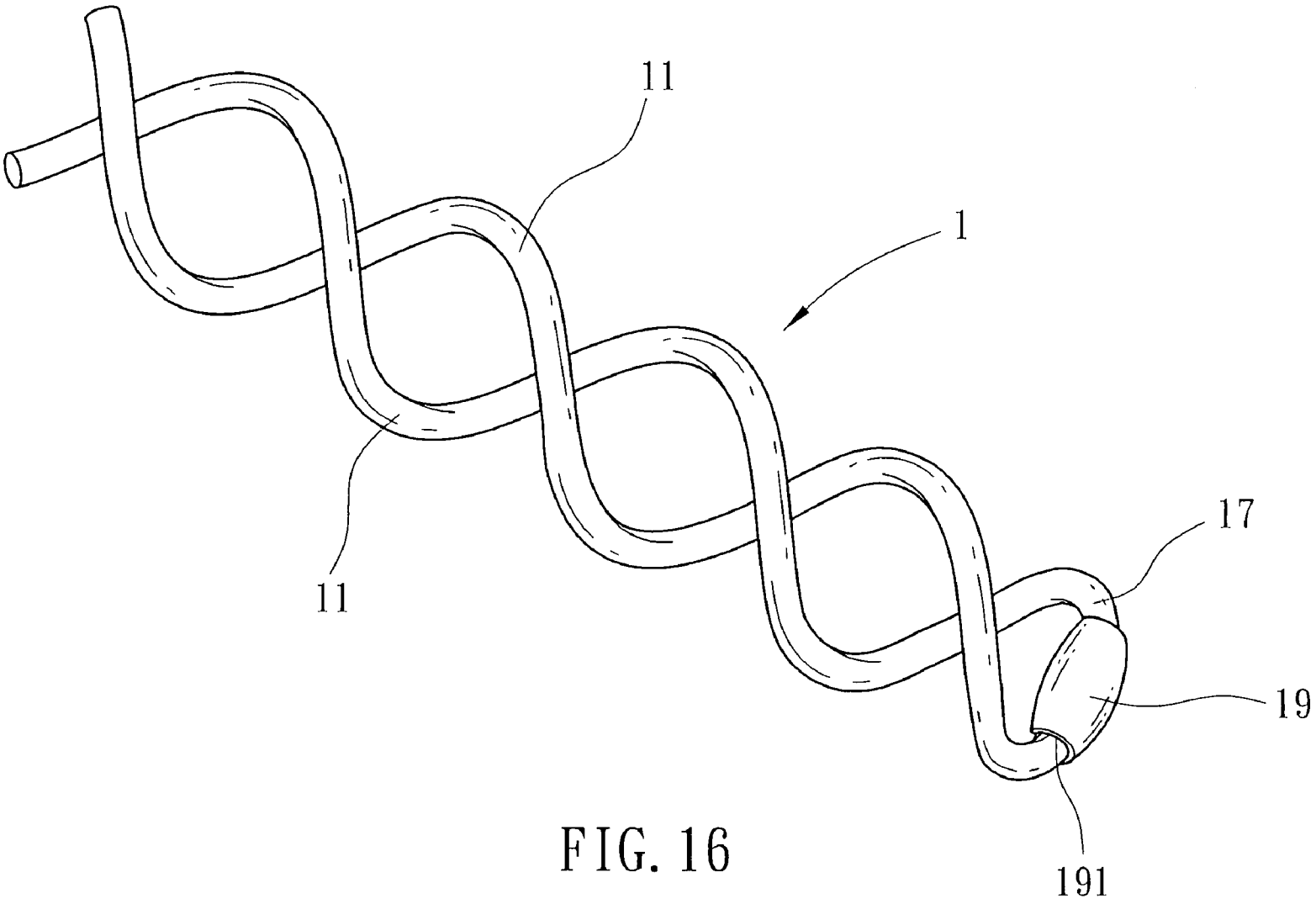
FIG. 16 illustrates a hair ornament in accordance with an eighth embodiment of the present invention.

FIG. 16 illustrates a hair ornament in accordance with an eighth embodiment of the present invention. This eighth embodiment is substantially similar to the aforesaid sixth embodiment with the exception that a plastic fitting 19 is used to substitute for the metal fitting 18. The plastic fitting 19 has a retaining groove 191 for fastening to the transverse connection rod portion 17.

Figure 17:
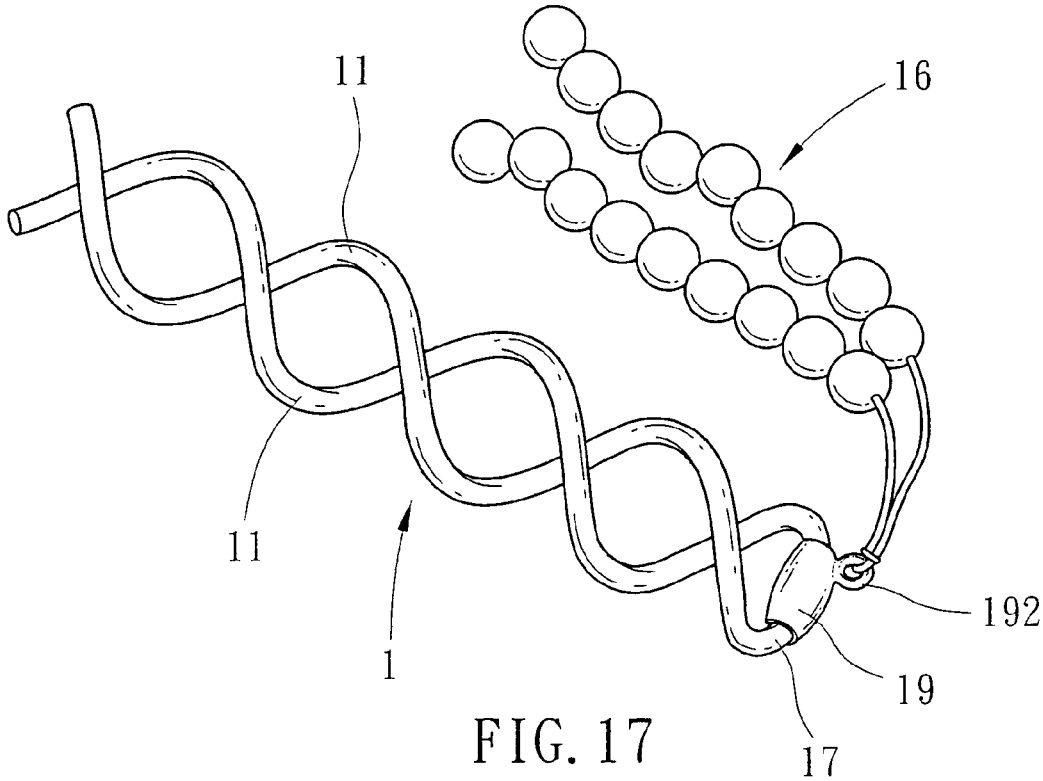
FIG. 17 illustrates a hair ornament in accordance with a ninth embodiment of the present invention.

FIG. 17 illustrates a hair ornament in accordance with a ninth embodiment of the present invention. This embodiment is substantially similar to the aforesaid eighth embodiment with the exception that the decorative plastic fitting 19 has a ring 192 for the mounting of ornamental strings of beads 16.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. An hair ornament, comprising:

a hairpin, said hairpin comprising an eyelet and two spiral spring wires extended from said eyelet and spirally intersected with each other;

an ornament, said ornament having a connecting element on a bottom side thereof; and a connector, said connector having a front end thereof fastened to said eyelet of said hairpin and a rear end thereof pivotally connected to said connecting element of said ornament, said connector having a connection rod located on the front end thereof and fastened to said eyelet of said hairpin, and a mounting lug located on the rear end thereof and pivotally connected to said connecting element, said connection rod being a metal rod having a free end thereof inserted through said eyelet and hammered down to form a head that firmly secures said metal rod to said eyelet.

2. The hair ornament as claimed in claim 1, wherein the axis of said eyelet extends in direction perpendicular to the extending direction of said spiral spring wires.

3. The hair ornament as claimed in claim 1, wherein said ornament carries a design.

4. The hair ornament as claimed in claims 1, further comprising decorative means fastened to said eyelet.

5. A hair ornament, comprising:

a hairpin, said hairpin comprising two spiral spring wires extended from said eyelet and spirally intersected with each other and a transverse connection rod portion connected between one end of each of said two spiral spring wires;

an ornament, said ornament having a connecting element on a bottom side thereof; and a connector, said connector having a front connection portion located on a front end thereof, a retaining groove defined in said front connection portion and fastened to said transverse connection rod portion of said hairpin, and a lug located on a rear end thereof and pivotally connected to said connecting element of said ornament.

6. A hair ornament, comprising:

a hairpin, said hairpin comprising an eyelet and two spiral spring wires extended from said eyelet and spirally intersected with each other;

an ornament, said ornament having a connecting element on a bottom side thereof; and a connector, said connector having a front end thereof fastened to said eyelet of said hairpin and a rear end thereof pivotally connected to said connecting element of said ornament, said connector having a connection rod located on the front end thereof and fastened to said eyelet of said hairpin, and a mounting lug located on the rear end thereof and pivotally connected to said connecting element, said connection rod being a plastic rod having a free end thereof inserted through said eyelet and molded by a hot press molding technique to form a head that firmly secures said connection rod to said eyelet.

7. The hair ornament as claimed in claim 6, wherein the axis of said eyelet extends in direction perpendicular to the extending direction of said spiral spring wires.

* * * * *